US012553686B1

(12) United States Patent
Ding et al.

(10) Patent No.: US 12,553,686 B1
(45) Date of Patent: Feb. 17, 2026

(54) COVER ASSEMBLY FOR WEAPON HANDGUARD

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 19/346,969

(22) Filed: Oct. 1, 2025

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41A 35/02; F41G 11/003
USPC ..... 42/90, 85, 96
See application file for complete search history.

(56) References Cited

U.S. PATENT DOCUMENTS

D625,378 S 10/2010 Fitzpatrick et al.
7,856,749 B2 * 12/2010 Fitzpatrick ..... F41A 35/02 42/96
7,971,383 B2 7/2011 Fitzpatrick et al.
D667,917 S 9/2012 Fitzpatrick et al.
D676,920 S 2/2013 Fitzpatrick et al.
D691,235 S 10/2013 Fitzpatrick et al.
D704,789 S 5/2014 Fitzpatrick et al.
D704,791 S 5/2014 Fitzpatrick et al.
9,222,749 B1 * 12/2015 Nakayama ..... F41A 35/02
D755,332 S 5/2016 Kielsmeier et al.
D759,185 S 6/2016 Kielsmeier et al.
9,702,655 B2 7/2017 Nakayama et al.
11,397,068 B2 7/2022 Lee et al.
2006/0191183 A1 * 8/2006 Griffin ..... F41C 23/16 42/72
2009/0241397 A1 * 10/2009 Fitzpatrick ..... F41C 23/16 42/90

(Continued)

OTHER PUBLICATIONS

"M-Lok Cable Management Covers—Long or Short", Strike Industries, https://www.strikeindustries.com/si-ar-cm-cover.html, at least as early as Sep. 26, 2025.

(Continued)

*Primary Examiner* — Michael D David
(74) *Attorney, Agent, or Firm* — Warner Norcross + Judd LLP

(57) ABSTRACT

A cover assembly for a weapon handguard can include a cover panel and end connectors configured to mount within an elongated slot, such as an M-LOK® style or other slot. The cover panel can include opposing interior rails that engage corresponding rails on the end connectors. Each end connector includes a capture flange that extends beyond the slot to engage the interior of the handguard, securing the cover panel externally without extending into the slot. Ramps on the cover panel and end connectors can urge the connectors apart along the slot, achieving a fixed spacing and securement. Cable slots can be defined between components to route cables under the cover panel and above the handguard. The assembly can enable a secure, tool-free attachment of a cover panel over a weapon handguard slot, allowing for cable management and protective coverage without permanent modification. A related method of use is provided.

20 Claims, 11 Drawing Sheets

(56) References Cited

U.S. PATENT DOCUMENTS

| | | | | |
|---|---|---|---|---|
| 2010/0300277 | A1* | 12/2010 | Hochstrate | F41A 3/66<br>42/71.01 |
| 2011/0099879 | A1* | 5/2011 | Fitzpatrick | F41A 35/02<br>42/90 |
| 2016/0091278 | A1* | 3/2016 | Jen | F41C 23/16<br>42/90 |
| 2016/0161206 | A1* | 6/2016 | Nakayama | F41C 23/16<br>29/428 |
| 2018/0031343 | A1* | 2/2018 | Caudle | F41A 3/86 |

OTHER PUBLICATIONS

"Siegen Rail Covers—Black (5-pack)", Strike Industries, https://www.strikeindustries.com/si-siegen-cover.html, at least as early as Sep. 26, 2025.

"M-Lok Cable Management G10 Rail Cover—Medium", Hogue, https://www.hogueinc.com/m-lok-cable-management-g10-rail-cover-medium?, at least as early as Sep. 26, 2025.

* cited by examiner

COVER ASSEMBLY FOR WEAPON HANDGUARD

BACKGROUND OF THE INVENTION

The present invention relates to handguards used on weapons such as firearms, and more particularly to cover systems that attach to the handguards.

Modern firearm handguards are often equipped with modular accessory mounting systems, such as the M-LOK® slot system, which features a series of elongated holes or slots along the length of the handguard. These slots provide a lightweight and versatile interface for attaching various accessories, including lights, grips, and bipods. However, the open-slot design, while beneficial for modularity and weight reduction, presents certain drawbacks during operations particularly related to heat, user comfort and user grip.

During extended firing sessions, the barrel and surrounding components can become extremely hot. This heat transfers through the handguard, and the open M-LOK slots provide minimal thermal insulation. As a result, users may be exposed to uncomfortable or even unsafe temperatures, especially if their hands are in direct contact with the bare handguard or near exposed metal surfaces.

To mitigate this, users often install cover panels over sections of the handguard. These panels can provide both a thermal barrier and an improved gripping surface. However, most existing cover panel solutions require the use of tools for installation and removal. These systems typically involve clamping mechanisms or fasteners that must be aligned within the M-LOK slots, making installation time-consuming and sometimes impractical in field conditions. Moreover, once installed, they may be difficult to reposition or remove quickly.

There is a need for an improved handguard cover assembly that can effectively shield the user from heat, offer a comfortable and secure grip surface, and install or remove easily-preferably without the use of tools. Further, there is room for improvement regarding such an assembly so it can engage existing slot geometry of the handguard without requiring permanent modifications or interfering with the mounting of other accessories.

SUMMARY OF THE INVENTION

The current embodiments provide a cover assembly for a weapon handguard having an elongated slot that allows for tool-free installation while shielding the user from heat and improving grip on the handguard.

In one embodiment, the cover assembly can include a cover panel and first and second end connectors that are separate and distinct from the cover panel. The cover panel can include an exterior surface and an interior surface and can be configured so that no part of the cover panel extends into or through the elongated slot, which can be but is not limited to an M-LOK® slot.

In another embodiment, the first and second end connectors can each include a base and a capture flange, with the base configured to fit between opposing side edges of an elongated slot defined by the firearm handguard. The capture flanges can be configured to engage an interior of the firearm handguard beyond the ends of the slot.

In still another embodiment, the cover panel can include a first cover rail and an opposing second cover rail. The capture flanges can be configured to engage an interior of the firearm handguard beyond the forward and rearward ends of the slot-rather than engaging opposing edges of the slot. The cover panel can engage the end connectors via the cover rails, securing the end connectors at a fixed distance from one another to retain the cover assembly in place without tools.

In yet another embodiment, the first and second end connectors can include connector rails that can engage the first and second cover rails of the cover panel. The first connector rail and a third connector rail can engage the first cover rail, while a second connector rail and a fourth connector rail can engage the second cover rail, thereby retaining the cover panel to the end connectors along both opposing sides.

In even another embodiment, the cover panel can include ramp features configured to engage corresponding ramp features on the first and second end connectors. The ramp features can be positioned to urge the end connectors in opposite directions along a longitudinal axis of the slot, spacing the end connectors apart and causing their respective capture flanges to engage the handguard, for example along its interior surfaces or other surfaces.

In a further embodiment, the first end connector can include a first end connector ramp, and the cover panel can include a first cover panel ramp that can engage the first end connector ramp to urge the first end connector toward a first slot end of the elongated slot. Similarly, the second end connector can include a second end connector ramp, and the cover panel can include a second cover panel ramp that can engage the second end connector ramp to urge the second end connector toward a second slot end.

In still a further embodiment, the cover panel can be a solid plate without apertures defined therein, and the first and second cover rails can be formed on the interior surface of the plate. The opposing cover rails can extend along a longitudinal axis of the cover panel and can be configured to retain wings or rails extending from each end connector.

In yet a further embodiment, the cover panel, first cover rail, and second cover rail can be configured such that no portion of them extends into the elongated slot of the handguard when the cover assembly is fully installed, thereby preserving the internal volume of the slot and avoiding interference with internal mounting hardware.

In even a further embodiment, the first and second end connectors can define respective cable slots positioned above the capture flanges and below the cover panel. These cable slots can be configured to receive and retain a cable that conveys electrical voltage, enabling cable management under the cover panel.

In a further embodiment, the cover panel and the first end connector can define a cable passageway therebetween through which a cable can extend. The cable passageway can be positioned between the first and second cover rails to protect and guide the cable during firearm operation.

In still a further embodiment, the cover assembly can include a ramp engaged between the cover panel and at least one of the end connectors. The ramp can urge the end connector between the opposing side edges of the slot toward one end of the slot to create a biased engagement that resists unintended displacement during use.

In yet a further embodiment, the first end connector can include first and second wings, and the second end connector can include third and fourth wings. The first and third wings can engage a first cover rail, while the second and fourth wings can engage a second cover rail. The opposing rails can extend longitudinally and retain the wings to prevent vertical or lateral displacement of the end connectors.

In another embodiment, a method is provided. The method can include providing a firearm handguard with an elongated slot, the slot having opposing side edges, a forward slot end, and a rearward slot end; inserting a first end connector into the slot and positioning it adjacent the forward slot end such that a first capture flange extends forwardly beyond the forward slot end and engages the interior of the handguard; and inserting a second end connector adjacent the rearward slot end such that a second capture flange extends rearwardly beyond the rearward slot end and engages the interior of the handguard.

In still another embodiment, the method can include joining a cover panel to the first and second end connectors after they are positioned in the slot. The cover panel can be configured to engage both end connectors and to space them apart at a fixed distance, urging the capture flanges into engagement with the handguard interior.

In yet another embodiment, the method can include urging the first and second end connectors away from one another using ramped surfaces on the cover panel and the end connectors, such that the end connectors are biased toward the respective forward and rearward slot ends to create a fixed, secure engagement.

In even another embodiment, the method can include defining cable slots above each capture flange and below the cover panel, and routing a cable through the slots or through a cable passageway defined between the cover panel and the end connectors.

The current embodiments provide a cover assembly for a firearm handguard and a method that can shield the user from heat, improve grip and handling, and allow for tool-free installation and removal. The cover panel can engage and retain end connectors that lock into place within a handguard slot using biased ramp engagement, without obstructing the interior of the slot or interfering with accessory mounting. Additionally, integrated cable management features can allow for routing of electrical cables beneath the cover panel in a protected, organized manner.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
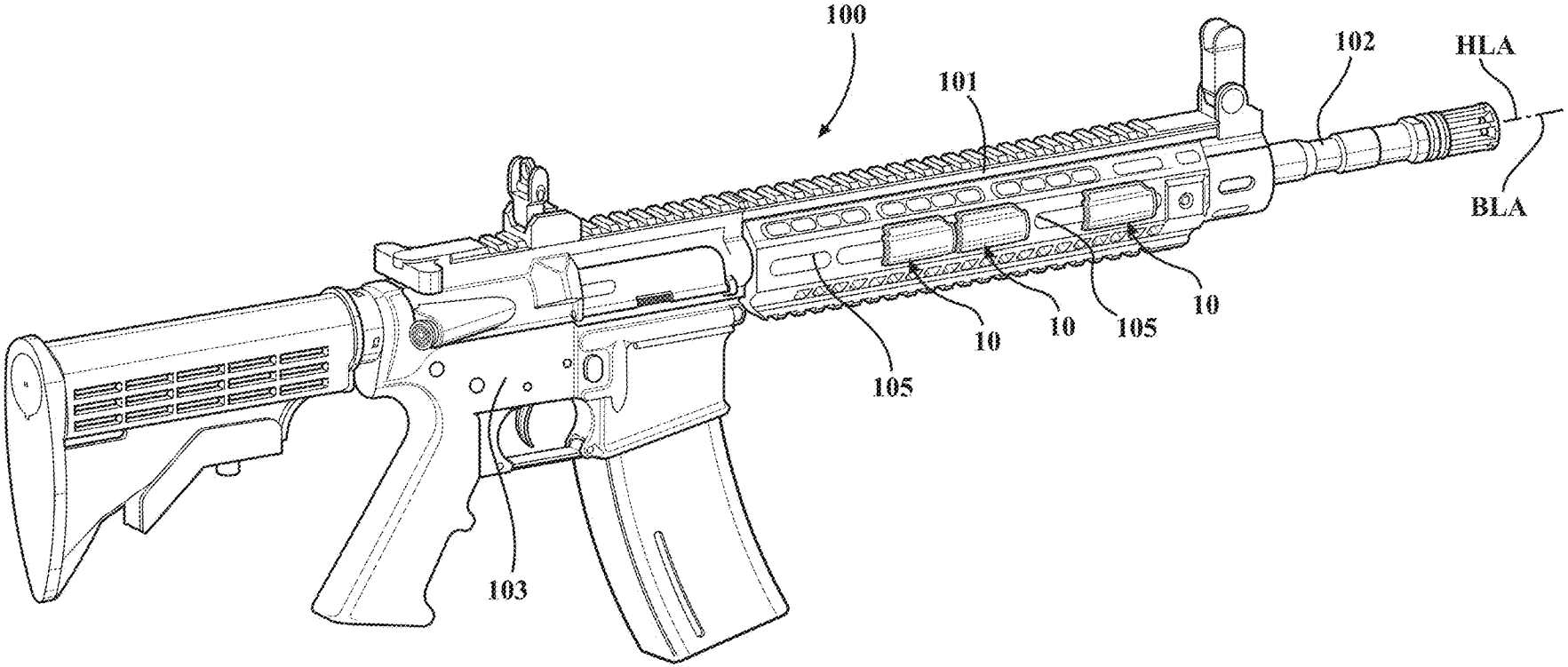
FIG. 1 is a perspective view of the cover assembly installed on a weapon handguard of a current embodiment.

A current embodiment of the cover assembly for a handguard of a weapon 100 is shown in FIGS. 1-6 and generally designated 10. In various embodiments, the weapon can include a handguard 101 that is mounted to a weapon 100, which as shown can be a firearm or other type of weapon, and extends along at least a portion of the firearm barrel 102. The handguard 101 can serve to provide a gripping surface for the user, shield the user from heat generated during operation, and/or offer a mounting platform for accessories such as optics, lights, lasers, and vertical foregrips.

The handguard 101 can be tubular, polygonal as shown, or partial wraparound in configuration and is typically formed from a lightweight, durable material such as aluminum, polymer, or a composite. The handguard can be mounted to the firearm using any conventional structures. Once installed, the handguard typically extends forward from the receiver 103 along a longitudinal axis BLA parallel to the barrel 102, substantially surrounding the barrel without direct contact. The handguard can define an interior cavity through which the barrel passes and can include openings for gas blocks or piston assemblies. In particular, the handguard can include an interior or interior surface 1011 and an opposing exterior or exterior surface 101E. The interior faces generally toward the barrel, and the exterior faces outward to the environment around the handguard.

The handguard 101 can define one or more elongated slots 105 that are configured for accessory attachment or integration with mounting hardware. These slots may conform to industry standards such as M-LOK®, KeyMod, or Picatinny-compatible profiles, or may have a proprietary design. Optionally, when the slots are in the M-LOK® configuration, the slots can have the following dimensions: approximately 32 mm (1.26 inches) in length, 7 mm (0.28 inches) in width, and can be spaced 8 mm (0.31 inches) apart from center to center of adjacent slots. As shown in FIGS. 1-4, each slot can be defined along a slot longitudinal axis SLA that runs parallel to the handguard longitudinal axis HLA, which itself is aligned with the barrel axis BLA of the firearm. Each slot can include a longitudinal slot axis SLA that extends forward and rearward along the length of the handguard, a transverse slot axis TSA that extends between the opposing side edges 105S of the slot 105, perpendicular to the longitudinal axis, spanning the slot width SW, and a vertical axis VA that extends radially inward and outward from the central bore of the handguard (i.e., toward or away from the barrel), and corresponds to the depth D of the slot or thickness of the handguard from the interior 1011 to exterior 101E.

The slot 105 can include opposing side edges 105S that define the width SW of the slot and are generally parallel to the longitudinal axis of the firearm. The slot can include a forward slot end 105F and a rearward slot end 105R that can define the slot length SL. The slot can be rectangular or elongated oval in shape, or other shapes. The slot can be sized to accept standard accessory mounting hardware for mounting accessories as well as the cover assembly 10.

As shown in FIGS. 1-4, any elongated slot 105S on the handguard can serve as the primary interface region for the cover assembly 10 disclosed in the current embodiments. For example, as described below, the first end connector 21 and second end connector 22 can include bases 21B and 22B that can be configured to fit within the space or slot width SW defined between the opposing side edges 105S of the slot 105. The capture flanges 21C and 22C on the end connectors 21 and 22 respectively can be configured to extend beyond the forward slot end 105F and the rearward slot end 105R respectively and can be adjacent and/or engage the interior surfaces 1011 of the handguard to retain the cover assembly 10 in place, fixedly secured to the handguard 101. The cover panel 30 can span over or adjacent the exterior surface 101E of the handguard, bridging the slot 105 from one side to the other, optionally without entering the slot or extending in the interior 1011 of the handguard 101.

Generally, the cover assembly 10 can be installed relative to a handguard, particularly in elongated accessory slots, such as M-LOK® slots or similar configurations. The cover assembly can be adapted for tool-free installation and removal, improved thermal shielding for the user, enhanced grip, and optional integrated cable management. The embodiments described herein are exemplary and non-limiting, and other configurations may be utilized without departing from the scope herein.

Figure 2:
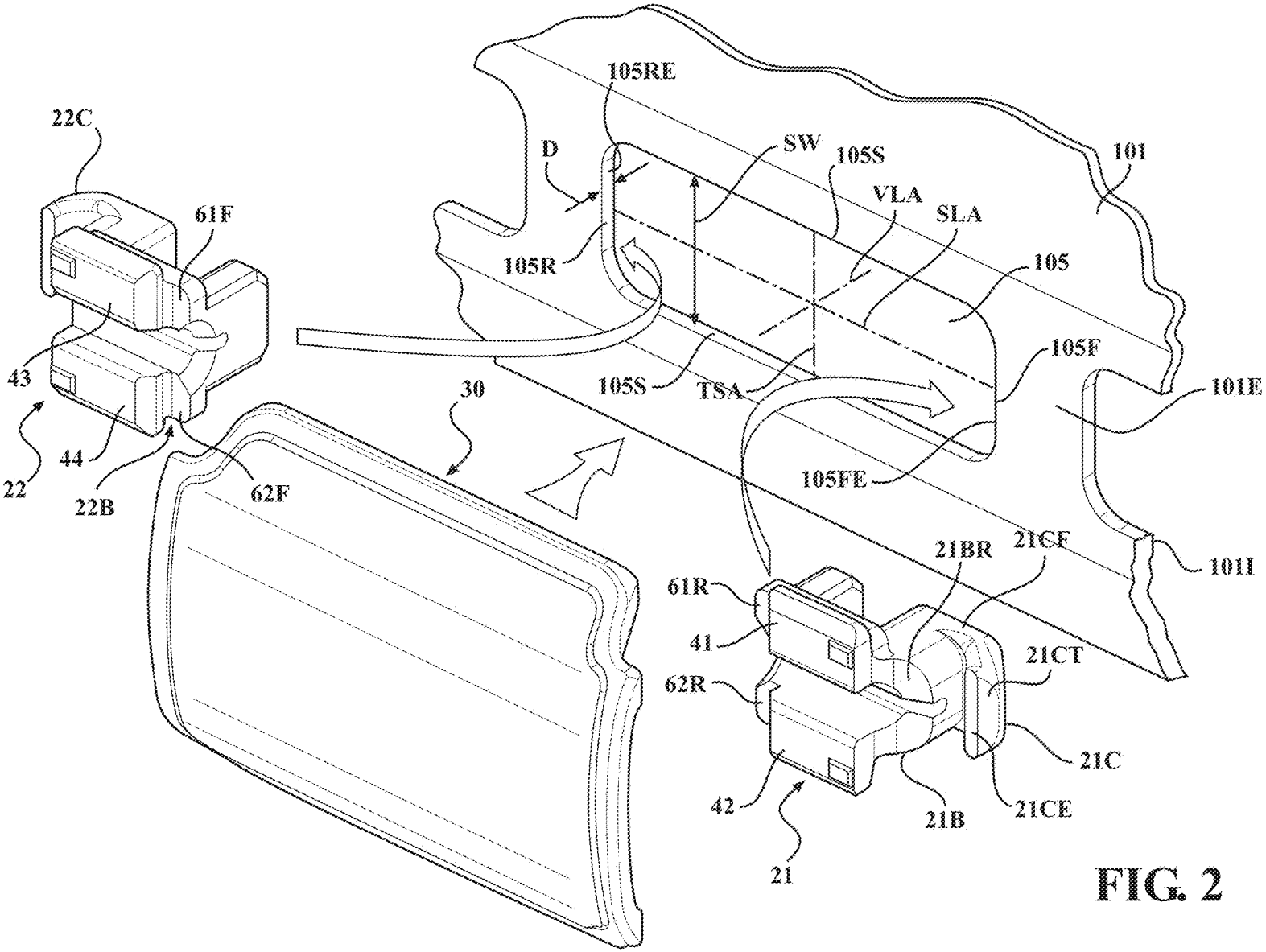
FIG. 2 is an exploded first perspective view of the cover assembly.
Figure 3:
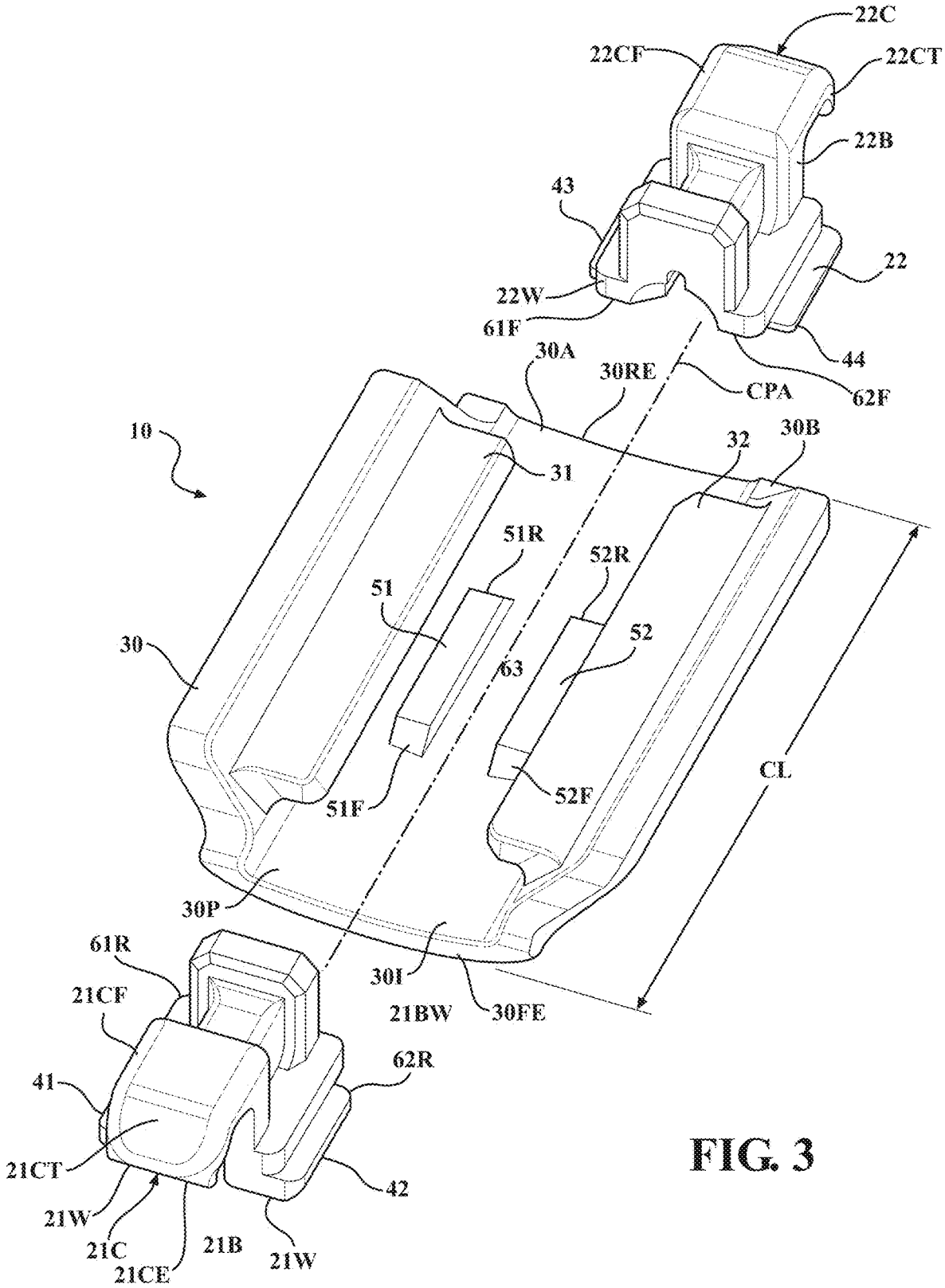
FIG. 3 is an exploded second perspective view of the cover assembly.
Figure 4:
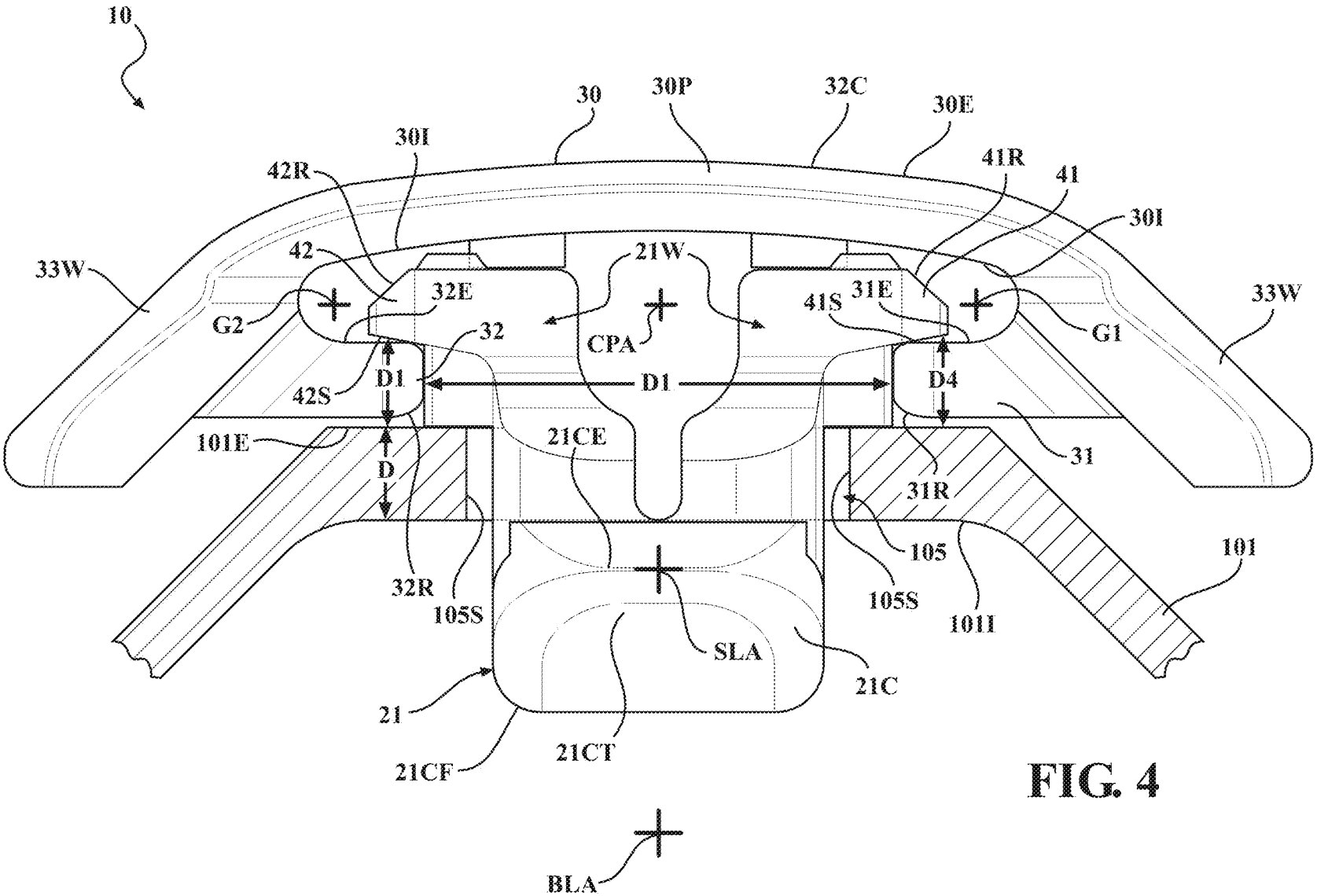
FIG. 4 is an end view of the cover assembly installed on the handguard.

Referring to FIGS. 1-4, the cover assembly can comprise a cover panel 30 and a pair of end connectors—a forward (first) end connector 21 and a rearward (second) end connector 22, each configured to engage with a longitudinal slot 105 in the handguard 101. The cover panel 30 can comprise a rigid or semi-rigid plate having an exterior surface (exposed to the user) and an interior surface (facing the barrel). The cover panel 30 can be a solid plate, of a variety of geometric configurations. As shown in FIGS. 3-4, the panel can include a main central portion 33C and wings 33W that can follow the contours of the handguard in a round or polygonal form. The exterior surface can be of a concave configuration for attachment of the cover panel to other components. Optionally, the cover panel can be a generally solid plate without any apertures defined therein or therethrough.

As shown in FIGS. 3 and 4, the cover panel can be constructed to include an interior 30I which can include a first cover rail 31 and an opposing second cover rail 32. The first cover rail 31 can be disposed on one side 30A of the cover panel axis CPA, and the second on the opposite side 30B of the cover panel axis CPA. The cover rails can extend longitudinally along the length CL of the cover panel 30.

The cover rails 31 and 32 can be configured to mechanically engage mating features on each of the end connectors. The rails 31 and 32 can include engagement surfaces 31E and 32E that face generally toward the interior surface 30I of the cover panel 30 as shown in FIG. 4. A first gap G1 can be formed between the first engagement surface 31E and the interior surface 30I adjacent the first rail 31. A second gap G2 can be disposed between the engagement surface 32E and the interior 30I adjacent the second cover rail 32. The cover panel rails and the respective gaps formed adjacent those rails can be configured to engage and/or receive the first connector and second connector.

For example, the first connector 21 can include a first connector rail 41 and a second connector rail 42. These rails can connect to the first base 21B of the first connector 21. The first connector rail 41 can fit within the gap G1 and can engage the first engagement surface 31E or the first cover rail 31, while the second connector rail 42 can fit within the second gap G2 and can engage the second engagement surface 32E of the second rail 32. The first connector rail and second connector rail can optionally push outwardly away from the cover panel axis CPA to interlock the rails of the end connectors to the cover panel rails, thereby holding and securing the cover panel to the respective connectors.

The cover panel rails 31 and 32 can extend toward the front 30FE and rear edges 30RE of the cover panel, optionally stopping short of those ends so they are not too visible from the ends of the cover panel. The cover panel rails also can include respective cover panel ramps 31R and 32R on a surface that faces away from the interior 30I of the cover panel 30. These cover panel ramps can be angled and/or rounded and configured to engage the corresponding ramps on the end connectors to facilitate installation of the cover panel relative to those connectors.

Figure 10:
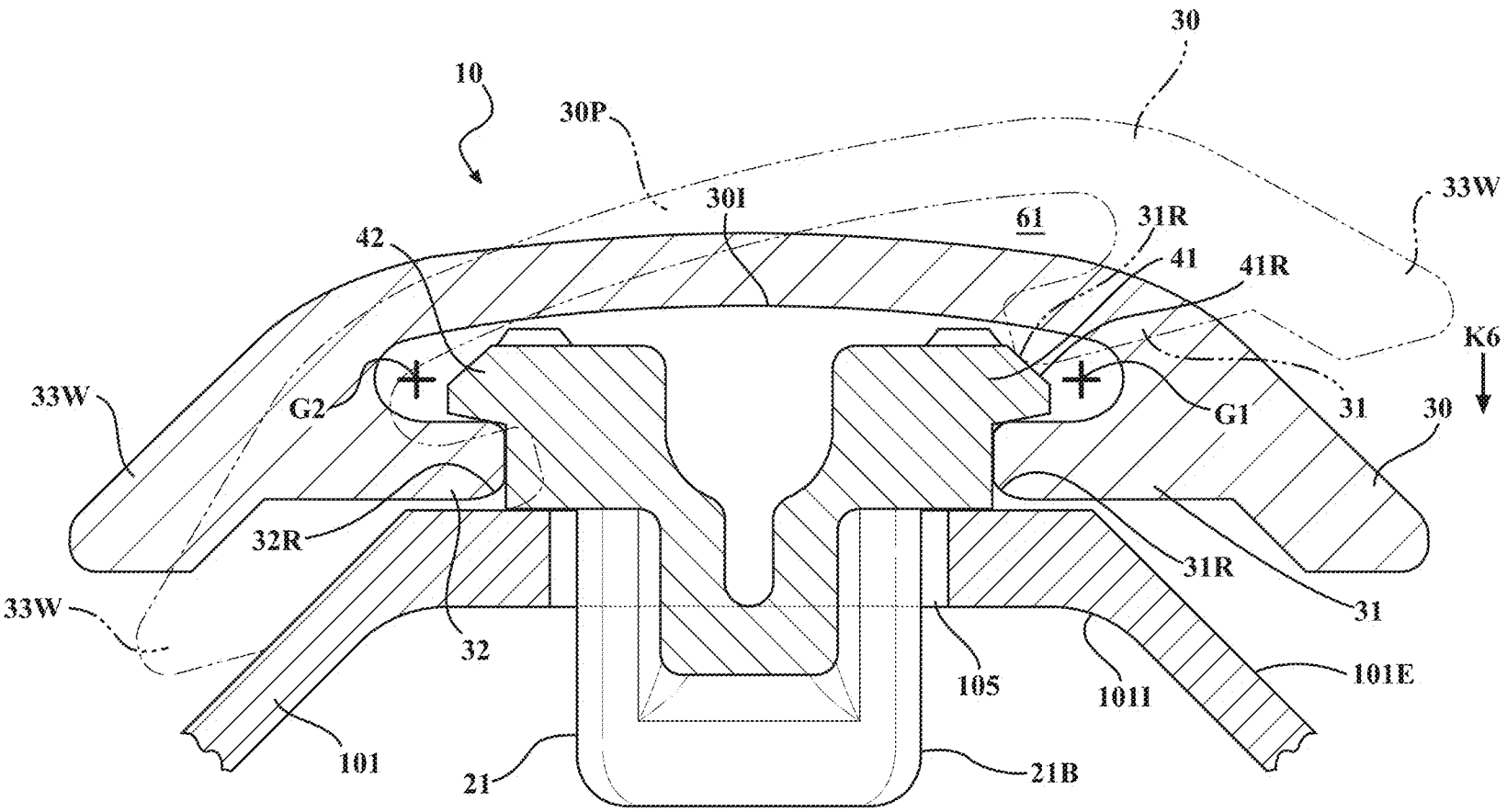
FIG. 10 is a section view of the cover panel being snap fit over the first and second end connectors upon installation thereof.
Figure 11:
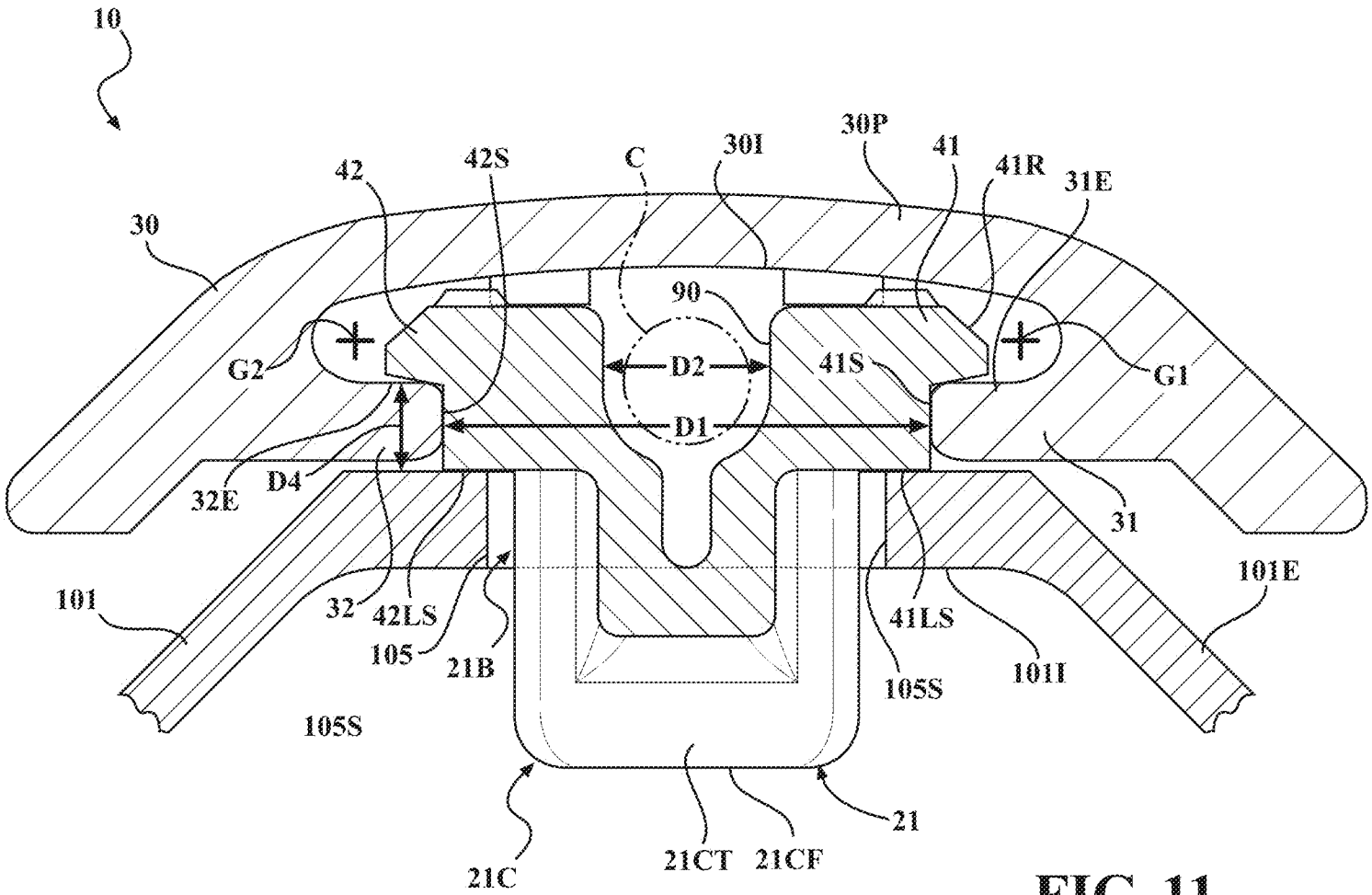
FIG. 11 is a section view of the cover panel installed relative to the first and second end connectors.

For example, as shown in FIGS. 10 and 11, the cover panel 30 is shown in a potential installation configuration. In FIG. 10, the cover panel 30 is brought into close proximity to the first connector 31, and also the second connector 32, which is not shown. The second connector rail 42 can be inserted into the second gap G2 between the cover panel rail 32 and the interior 30I of the cover panel 30. The cover panel 30 can be tilted in direction K6 toward the handguard 101, such that the first cover panel rail 31 moves toward the first connector rail 41. The first ramp 31R of the cover panel rail 31 can engage the first ramp 41R of the first connector rail 41. Because these surfaces can be generally ramped, or at least one of them can be, they can interface with one another to allow the first rail 31 to clear the first connector rail 41. For example, when the user tilts the cover panel 30 farther in direction K6, the ramp 31R of the first cover rail 31 can ride over the ramp 41R of the first connector rail 41. In doing so, the cover panel 30 may bend or slightly flex to allow the distance D1 shown in FIG. 4 to increase to a greater distance so that the first cover rail 31 can clear the first connector rail 41. Again, the expansion of the distance between the rails and increase in that distance D1 can be facilitated by the interaction of the ramps described above.

When the ramp 31R and the first cover rail 31 clears the first connector rail 41, the first cover rail 31 can snap-fit under the first connector rail 41 against a shoulder 41S under that rail 41 and under the first connector ramp 41R. When this occurs, there can be an audible snap or other output perceivable by the user to inform the user that the cover panel 30 has been satisfactorily installed relative to the end connectors, for example, the first connector 21 shown in FIG. 11 can be.

In this configuration, shown in FIG. 11, the first connector rail 41 can be disposed in the gap G1 and the second connector rail 42 can be disposed in the second gap G2. The underside of the shoulder 41S can engage the first engagement surface 31E of the first cover rail 31. The underside of the shoulder 42S can engage the engagement surface 32E of the second cover rail 32. These components can thereby interlock, thereby securing the cover panel 30 to the end connectors 21 and 22 that are associated with the slot 105 of the handguard 101 as described further below.

Optionally, the opposing first and second connector rails 41 and 42 can be disposed across a cable slot 90 from one another. This cable slot can be configured to receive a cable C. The ends can define and can form a cable passageway in combination with the interior 30I of the cover panel 30. The cover panel thus can cover the cable slot 90 and constrain any potential cable disposed in the cable slot 90 to the cover assembly 10, thereby holding it and securing it, and in many cases, concealing it.

During the installation of the cover panel 10 relative to the end connectors shown in FIGS. 10 and 11, in some cases, those connector rails 41 and 42 optionally can be spaced across the cable slot 90 a distance D2. When the cover panel 30 is tilted in direction K6 or otherwise slid, moved or installed relative to those connector rails 41 and 42, in some cases, the ramp engagement as described above can cause that distance D2 to decrease, thereby offering the first cover rail 31 some extra clearance to allow that cover rail 31 to pass by and over the ramp 41R and into the shoulder 41S or generally under the ramp 41R as shown in FIG. 11. In some cases, the distance D2 between the connector rails 41 and 42 can decrease, while the distance D1 between the cover rails can increase to allow the cover panel to be installed relative to the respective end connectors 21 and 22. Of course, where the cable slot 90 is absent from the construction, that decrease in distance D1 may or may not occur.

Optionally, the cover panel 30 can include one or more secondary ramps 51 and 52. These secondary ramps 51 and 52 can facilitate moving urging and/or biasing the end connectors into a locked position against the handguard slot ends as described in further detail below. These secondary ramps 51 and 52 can be disposed on opposite sides of the cover panel axis CPA. Although shown as two opposing ramps, these alternatively can be a unitary integral ramp feature. With the gap G3 formed therebetween, however, extra clearance can be allowed for a cable that is disposed in the cable slot 90 of the respective first and second end connectors.

As shown in FIG. 3, the ramps 51 and 52 can include respective forward secondary ramps 51F and 52F as well as rearward ramps 51R and 52R. The forward secondary ramps 51F and 52F can be configured to engage the first end connector 21 to urge the first end connector toward one end of a slot that the end connector is placed within. The rearward ramps 51R and 52R can be configured to engage the second end connector 22 to urge the second end connector toward the other end of the slot that the end connector is placed within. Generally, these ramped features, which will be described in further detail regarding their interaction with the end connectors, can ensure that the respective capture flanges 21F and 22F satisfactorily engage the slot in the handguard to secure those end connectors and thus the cover panel when it is attached to those end connectors to the handguard.

In the current embodiment shown in FIGS. 1-4 and 9, the cover panel 30 can be configured such that no portion of it extends into or through the elongated slot of the handguard. For example, the cover plate 30P of the cover panel, which can include the central portion 33C and the wings 33W, is configured so that it does not extend into and/or through the slot 105. The rails 31 and 32 also can be configured so that they do not extend into and/or through the slot 105. The ramp features 51 and 52 likewise can be configured so that they do not extend into or through the slot.

Optionally, the cover assembly 10 can be constructed so that while the first and second end connectors 21 and 22 extend into and/or through the slot, passing into the interior or otherwise engaging the interior surface on a surface of the handguard 101, the cover panel and its components optionally can remain exterior to the handguard and do not pass into or through the slot. This can facilitate installation and assembly of the cover panel 30 relative to the end connectors 21 and 22.

The end connectors 21 and 22 will now be described in further detail. These end connectors can be virtually identical to one another except reversed in orientation within the slot. For example, the first end connector 21 can include a first capture flange 21C that can be oriented so that it faces toward the forward slot end 105F. The second end connector 22 can include a second capture flange 22C that can be oriented so that it faces toward the rearward slot end 105R. The two capture flanges, however, can be virtually identical, and the end connector is just reversed depending on whether it is configured to be facing the forward slot end or the rearward slot end.

As shown in FIGS. 1-4, each end connector can be independent and separate from the cover panel. Again, the first end connector can be configured to be inserted into a forward region of the handguard slot 105, while the second end connector can be configured for insertion into a rearward region of the slot 105. Each end connector can include a base 21B and 22B that are sized to fit between opposing side edges 105S of the slot and a capture flange extending from the base. For example, the base 21B, which can be identical to the base 22B of the second end connector 22, can include a base width 21BW. This base width 21BW can be less than, equal to, or slightly greater than the slot width SW such that the base can be pushed into and extend into the slot, and can interface optionally with the side edges 105S of the slot. In some cases, there can be a slight interference fit so that the base fits snugly within the slot, frictionally held therebetween the side edges 105S.

As noted above, the end connectors 21 and 22 can include respective capture flanges 21C and 22C. These capture flanges can project from the respective bases 21B and 22B of the end connectors. Each capture flange can be generally identical, so only the first capture flange 21C will be discussed here. As shown in FIGS. 2 and 3, the capture flange 21C can project forwardly from the base 21B. The capture flange can include a foot 21CF that projects forwardly from the base 21B. The foot can terminate at a respective toe 21CT. This toe can have an engagement surface 21CE. This engagement surface can be the surface that engages the interior surface 1011, for example, as shown in FIG. 4.

Generally, the capture flanges 21C and 22C can be configured to project beyond the forward or rearward ends of the slot 105F and 105R, respectively, and to engage internal surfaces of the handguard. In some cases, the bases of the connector ends can engage the forward slot edge 105FE and the rearward slot edge 105RE, respectively. This engagement helps to retain the cover assembly in place during use. Of course, in some applications, the engagement surfaces, for example, 21CE, do not contact directly the internal surface or interior 1011 of the handguard 101, but merely rest immediately adjacent to it such that if the cover assembly 10 is moved or tilted slightly within the slot, it will or does contact that interior surface and prevent the assembly 10 and/or the cover panel 30 from becoming detached or removed from the handguard 101.

Optionally, the base of the end connectors 21 and 22 can include a ramp 21BR that can be reproduced in the first end connector 21 as well as the second end connector 22. The ramp 21BR can be configured to engage the forward edge 105FE as shown in FIG. 2 of the slot 105 and assist in fitment of the base within the slot. In some cases, that ramp 21BR can ride or slide along the edge 105FE to friction-fit the base 21B within the slot and provide additional securement of the end connector 21 in the forward slot end 105F or the slot 105 in general.

As mentioned above, the first and second end connectors 21 and 22 can include connector rails 41 and 42 that engage the cover panel's opposing cover rails 31 and 32 to secure the cover panel 30 to the connectors 21 and 22. For example, the first end connector 21 can include the first connector rail 41 and an opposing second connector rail 42, and the second end connector 22 can include a third connector rail 43 and an opposing fourth connector rail 44 as shown in FIGS. 2 and 3. The interlocking of these connector rails with the cover rails secures the end connectors to the cover panel and maintains a fixed spacing between them as described above.

Optionally, the connector rails 41 and 42, as mentioned above, can lay on opposite sides of a cable slot 90. As shown in FIG. 11, the connector rails can extend downward to respective lower shoulders 41LS and 42LS. These lower shoulders can contact or engage the exterior surface 101E of the hand guard 101 immediately adjacent the slot 105. For example, when the base 21B is installed in the slot 105 and extends downward along the side edges 105S of the slot, the depth of entry into the slot can be limited by the respective lower shoulders 41LS and 42LS engaging the exterior surface 101E of the hand guard 101. Optionally, this depth of entry into the slot can permit the capture flange 21C to be disposed lower than or more inward than the interior surface 1011 of the hand guard 101. This allows, as described below, when the end connector is slid, for example forwardly toward the slot end 105F, the capture flange and respective engagement surface 21CE thereof to clear or frictionally engage the interior surface 1011 of the hand guard 101, securing the end connector further to the hand guard in the slot.

As shown in FIG. 4, the first end connector 21 can include first and second wings 21W that extend to opposite sides of the base 21B. Likewise, the second end connector 22 can include third and fourth wings 22W that extend to opposite sides of the base 22B. These wings can optionally engage the opposing rails 31 and 32 of the cover panel that extend along the longitudinal axis CPA of the cover panel. These wings can include the respective connector rails 41 and 42, as well as the various shoulders, ramps, and other components described above in connection with those features. In some cases, these wings also include the lower shoulders 41LS and 42LS that engage the hand guard to set the depth of the connector when installed relative to the ramp, optionally ensuring that there is an adequate depth D4 established between the shoulders 41LS and 42LS and the exterior surface 101E of the hand guard such that the respective cover panel first and second rails 31 and 32 can fit between those elements and secure the cover panel 30 to the respective end connectors 21 and 22.

As mentioned above, the first and second end connectors can be substantially identical, so all features and components described above in connection with the first end connector apply to the second end connector as well. These will not be described again in detail here.

A method of using the cover assembly 10 will now be described in further detail with reference to FIGS. 7-11. Generally, the method includes providing a hand guard 101 with an elongated slot 105 defined thereby, the slot including opposing side edges 105S, a forward slot end 105F, and a rearward slot end 105R; moving a first end connector 21 toward the forward slot end 105F so that a first capture flange 21C of the first end connector 21 is positioned adjacent to the interior surface 1011 of the hand guard and extends forwardly beyond the forward slot end 105F; moving a second end connector 22 toward the rearward slot end 105R so that a second capture flange 22C is positioned adjacent to the interior surface 1011 of the hand guard 101 and extends rearward beyond the rearward slot end 105R; and joining the cover panel 30 with the first and second end connectors 21 and 22 after those elements are disposed in the slot to secure the cover panel adjacent the hand guard 101.

Figure 5:
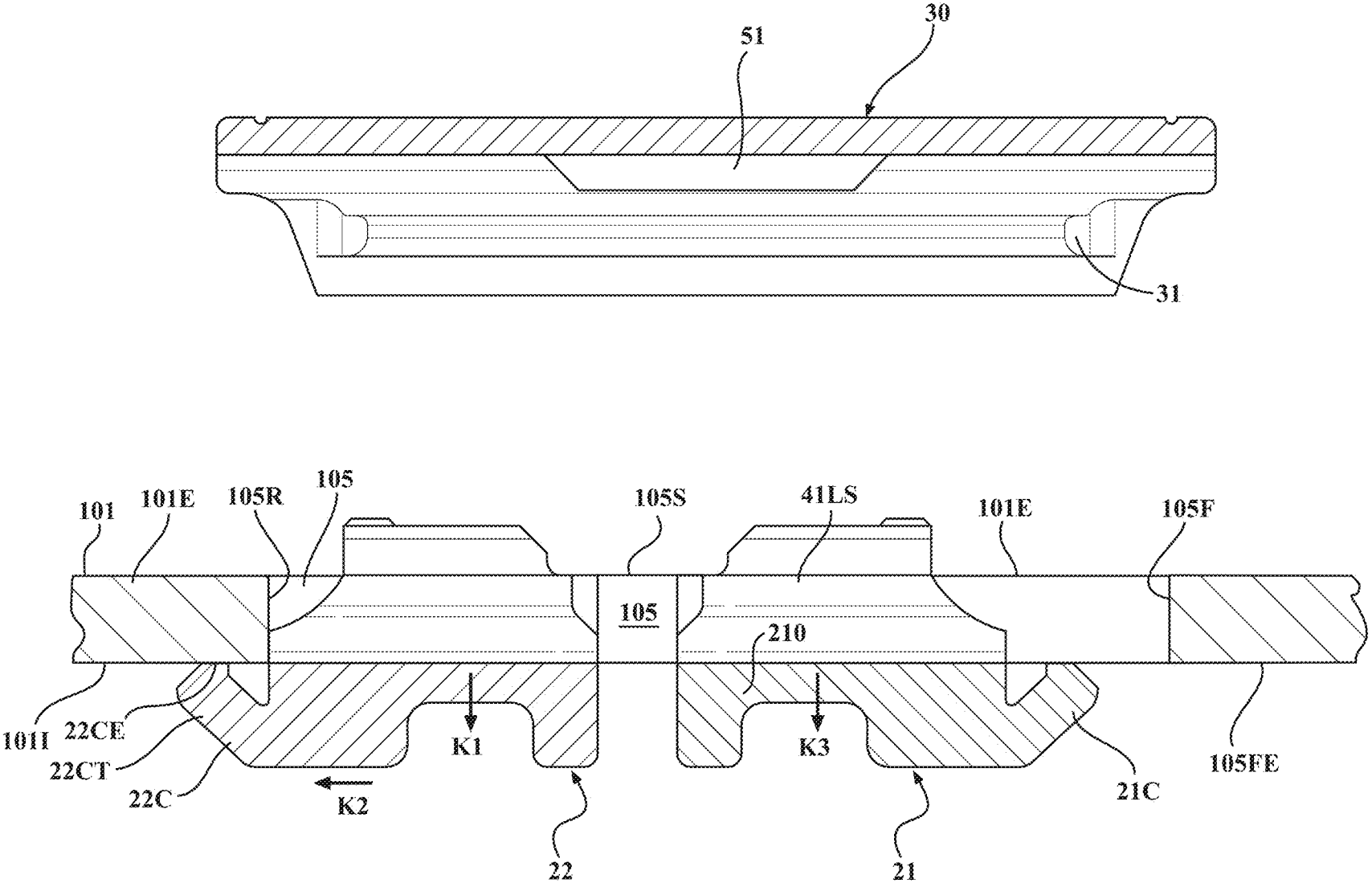
FIG. 5 is a bottom view of the cover assembly with a first end connector and a second end connector engaging opposing rails on the cover panel.

With reference to FIG. 5, the second end connector 22 can be moved in direction K1 so that the lower shoulder 43LS engages the exterior surface 101E of the hand guard 101. The second end connector 22 can be moved in direction K2 such that the capture flange 22C moves under or inward from the interior surface 1011 of the hand guard. The toe 22CT and engagement surface 22CE can be disposed beyond the rearward slot end 105R in this movement and be adjacent to or near the interior surface 1011 of the hand guard 101. Again, the interaction of the lower shoulder 43LS optionally can set the depth of installation of the second end connector 22.

The first end connector 21 can be moved in direction K3 and installed in the slot 105. The respective lower shoulders 41LS and 42LS can stop installation of the end connector into the slot upon engagement with the exterior surface 101E of the hand guard. As shown in FIG. 5, however, the first end connector is installed so that the capture flange 21C does not extend beyond the forward slot end 105F. There, the base 21B may only be frictionally held between the opposing side edges 105S of the slot. The cover panel 30 can then be positioned for installation above the end connectors 21 and 22.

Figure 6:
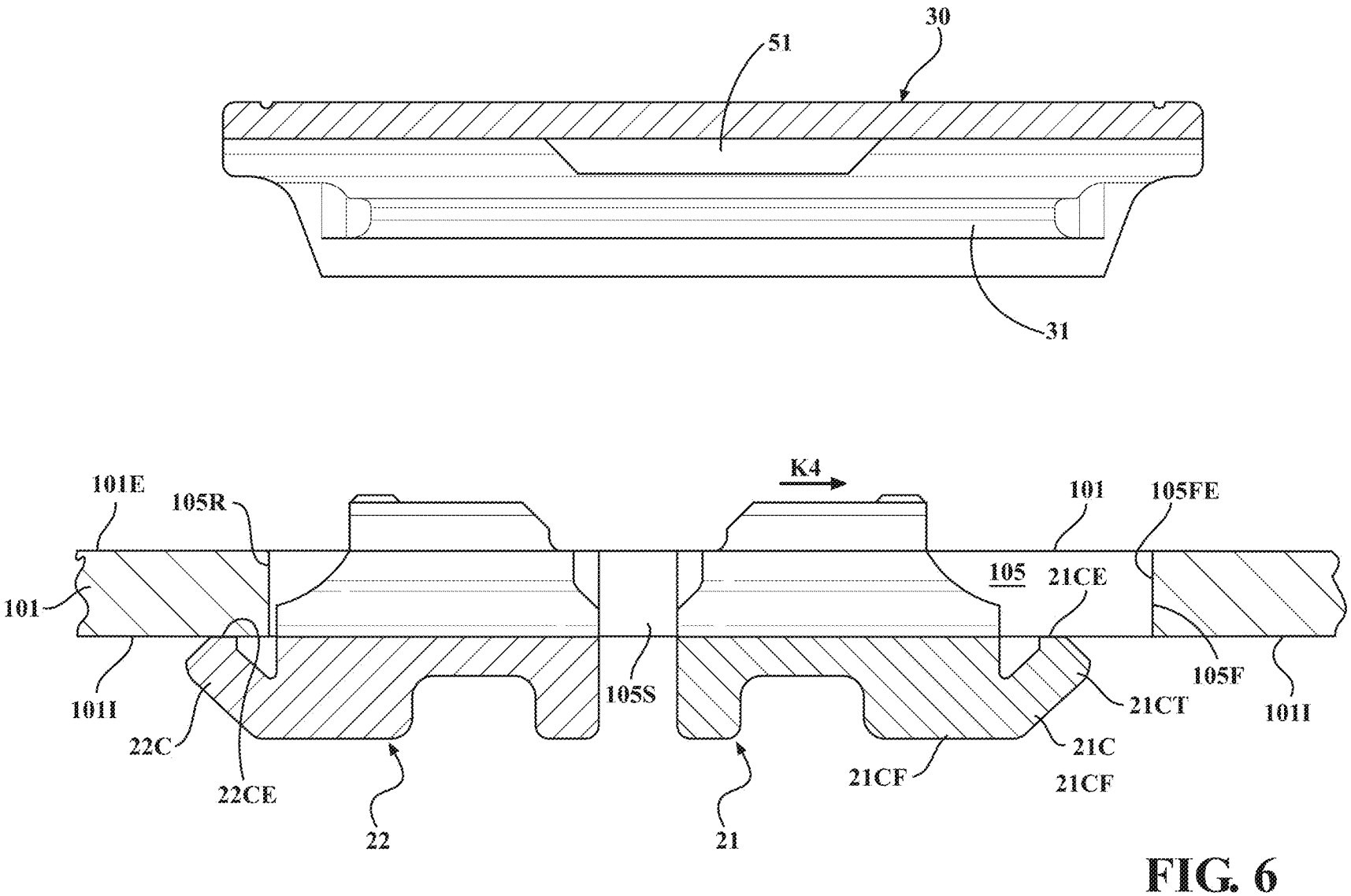
FIG. 6 is a section view of the first end connector and the second end connector being installed in a slot defined by the handguard, and the cover panel being aligned above the connectors.

As shown in FIG. 6, the first end connector 21 can be moved by the user in direction K4 toward the forward slot end 105F so that the first capture flange 21C aligns with and moves toward a position under the interior surface 1011 of the hand guard, securing the first connector 21 to the hand guard 101. Likewise, the foot 21CF, toe 21CT, and engagement surface 21CE of the capture flange 21C move in direction K4, generally within and under the slot 105 but not yet under the interior surface 1011 forward of the slot end 105F.

Figure 7:
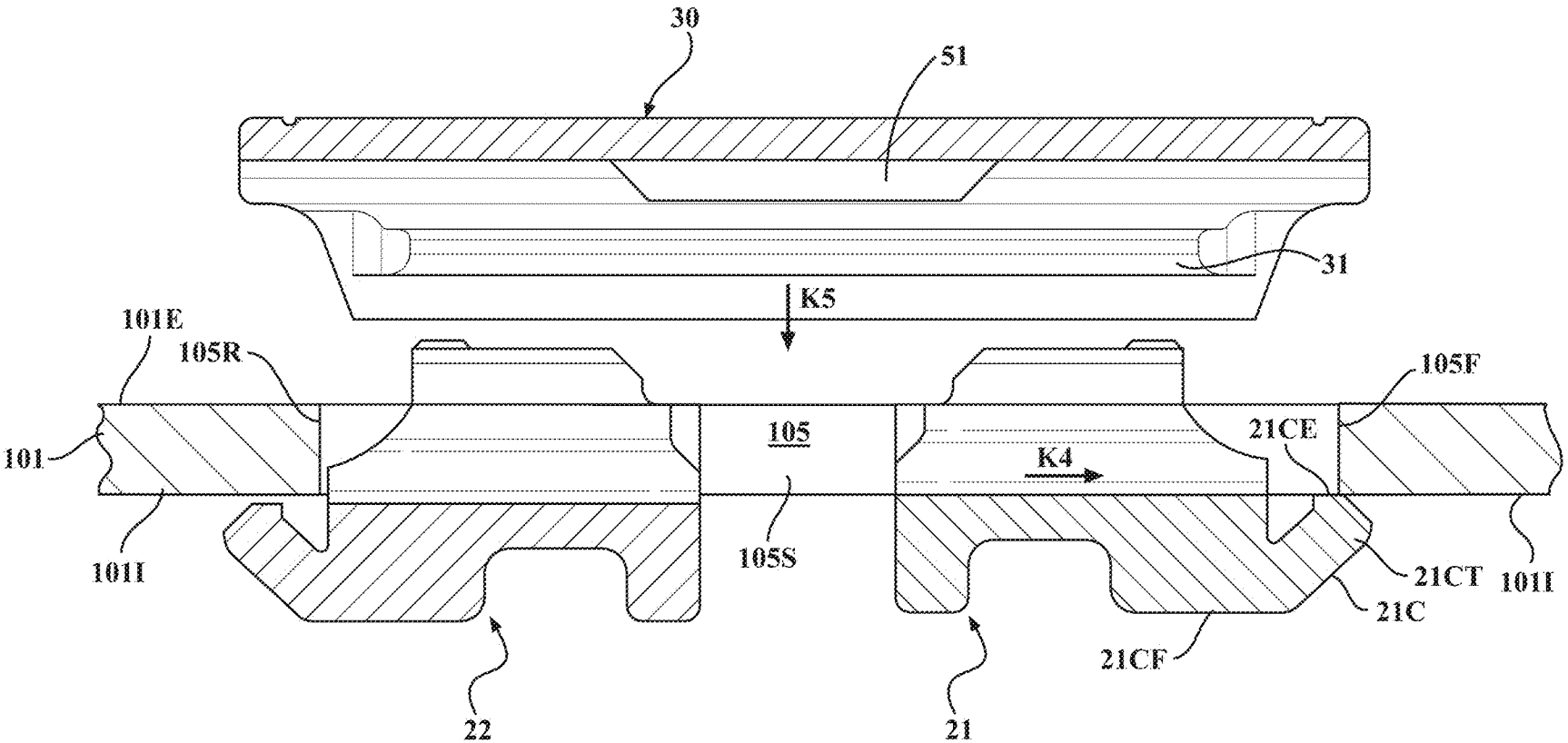
FIG. 7 is a section view of the first end connector being moved forwardly toward a front slot end of the slot before installation of the over plate being over the connectors.

As shown in FIG. 7, movement in direction K4 continues and the capture flange 21C begins to be disposed forward of the forward slot end 105F, optionally with a portion of the engagement surface 21CE contacting or adjacent to the interior surface 1011 of the hand guard 101. At this point, the first end connector 21 be partially engaged with the slot 105; however, the capture flange 21C and engagement surface 21CE may not yet be fully engaged with the interior surface 1011 to fully secure the first end connector 21 and thus the cover panel 30. Installation of the cover panel 30, which includes moving the cover panel 30 toward the end connectors in direction K5, can supplement the movement in direction K4 to further or fully engage the first capture flange 21C with the hand guard and thereby secure the first end connector 21. Of course, this description primarily focuses on moving the first end connector 21, however, the second end connector or both end connectors can be moved similarly or oppositely to engage their respective capture flanges with the interior of the hand guard, depending on the application and configuration of the slot and hand guard.

As mentioned above, the cover panel 30 can be moved in direction K5, as shown in FIG. 7, such that a cover rail 32 engages the connector rail 42. The user can further engage the cover rails and connector rails, and tilt the cover panel in direction K6, as shown in FIG. 10, until the cover panel 30 is secured to the end connectors, as shown in FIG. 11. This action and movement are described above. During this tilting action and installation of the cover panel relative to the end connectors, both end connectors 21 and 22 can be urged toward the respective forward slot end 105F and/or rearward slot end 105R to further ensure that the capture flanges 21C and 22C are adjacent to and/or fully engaged with, contacting, and/or operatively adjacent or coupled to the interior surface of the hand guard 101.

Figure 8:
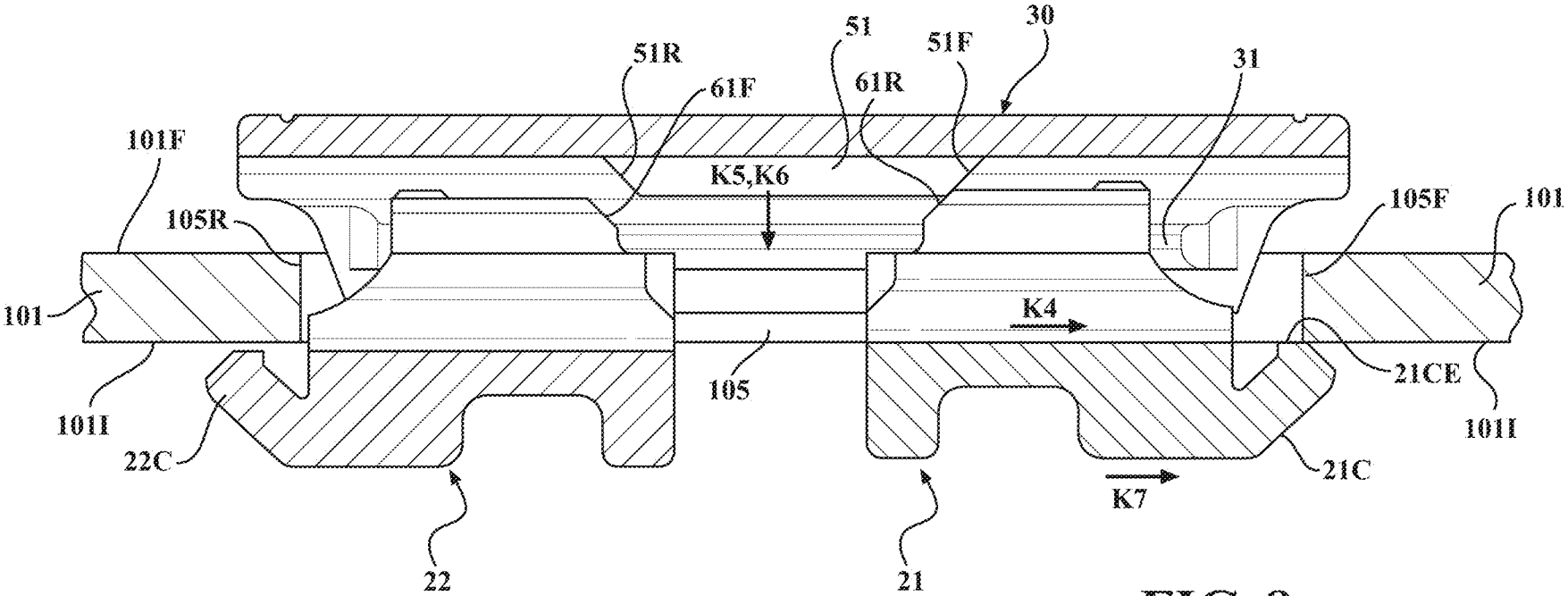
FIG. 8 is a section view of the first end connector being moved further forwardly toward a front slot end of the slot via a ramp on the cover engaging a ramp on the first connector.
Figure 9:
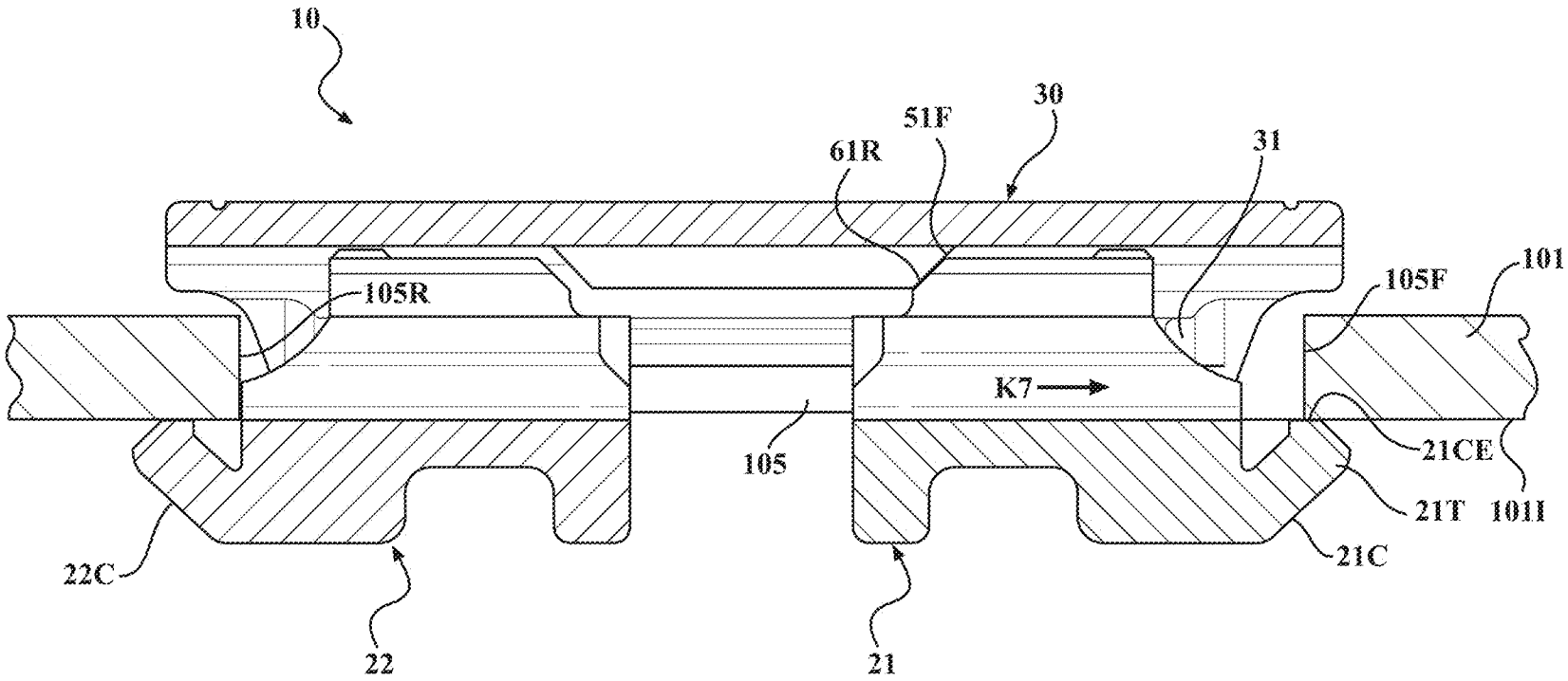
FIG. 9 is a section view of the first end connector moved sufficiently forwardly toward a front slot end of the slot via the ramp on the cover engaging a ramp on the first connector.

For example, as shown in FIG. 8, when the cover panel is installed and tilted relative to the end connectors 21 and 22, the secondary ramps 51F and 51R can align with the corresponding movement ramps 61R and 61F of the respective first end connector 21 and second end connector 22. These end connectors can include respective movement ramps; for example, the first end connector 21 can include rearward-facing movement ramps 61R and 62R, as shown in FIGS. 2 and 3, and the second end connector 22 can include forward-facing movement ramps 61F and 62F. These respective movement ramps on the end connectors correspond to the respective secondary ramps 51 and 52, particularly ramps 51R, 52R, as well as 51F and 52F. These ramps can engage one another and urge the first end connector and/or the second end connector away from one another and generally toward their respective slot ends.

For example, as shown in FIG. 8, the forward-facing secondary ramp 51F aligns with the rearward-facing movement ramp 61R of the first end connector 21. As the secondary ramp 51 moves in direction K5 due to tilting in direction K6, those ramps interface with one another and urge the first end connector 21 further in direction K7 toward the slot end, so that the capture flange 21C extends beyond, or farther beyond, the slot end 105F. This is shown further in FIG. 9, where movement in K7 continues due to the interaction of ramps 51F against 61R, thereby urging the capture flange 21C such that the toe 21T and the capture flange engagement surface 21CE are disposed substantially under the interior surface 1011 and aligned with or past the slot end 105F of the slot 105. In this manner, the first end connector 21 and the second end connector 22 are fully captured via their capture flanges 21C and 22C relative to the hand guard and can withstand pulling or movement out of the slot 105. Thus, the cover panel 30 remains attached to those elements, completing the cover assembly 10 and securing it to the hand guard 101.

Generally, the interaction of the cover panel with the end connectors facilitates tool-free installation and secure engagement via cooperative ramped surfaces between the cover panel and the end connectors. For instance, the cover panel can define first and second cover panel ramps configured to engage respective first and second connector ramps on the end connectors. These ramp interactions can urge and/or bias the first end connector toward the forward end of the slot and/or the second end connector toward the rearward end, thereby urging the capture flanges into firm engagement or adjacency with interior surfaces of the hand guard. This biasing effect enhances retention and minimizes unintended displacement. Optionally, a separate ramp component may be disposed between the cover panel and one or both end connectors to further bias them longitudinally into their respective slot ends.

As mentioned above, the end connectors can include respective rails 41, 42, 43, and 44 extending laterally to engage the interior cover rails 31 and 32. For example, the first end connector may include first and second wings engaging the first and second cover rails, respectively. Likewise, the second end connector may include third and fourth wings engaging the opposing cover rails. These wings can be retained longitudinally by the rails and laterally constrained to prevent motion in vertical or lateral directions.

Optionally, the cover assembly 10 can include one or more cable slots 90 defined by the respective end connectors 21 and 22. In such instances, before installation of the cover panel 30 relative to the end connectors, a cable C, shown in FIG. 11, can be installed in the respective slots and extend longitudinally or in some other direction through the end connector. The cover panel can then be installed relative to the end connectors and secured thereto, with the cable being trapped between the cover panel and the end connectors, optionally disposed within the cable slot 90. In this manner, the cable can be routed and managed within the cover assembly 10, optionally within multiple cable slots of multiple cover assemblies along the length of the hand guard. The cable slots can be configured to retain and guide one or more electrical cables used for powering accessories such as lights or lasers. Further optionally, the interface between the cover panel and one or both end connectors may define a cable passageway, allowing a cable to pass between the components in a protected channel. In specific embodiments, this passageway can be located between the first and second cover rails on the underside of the cover panel.

As will be appreciated, installation of the cover assembly of the current embodiment can be performed without tools. In one exemplary method, the first end connector is inserted into the slot and moved toward the forward end such that its capture flange extends forwardly beyond the slot to engage the hand guard interior. The second end connector is then inserted adjacent the rearward end of the slot so that its capture flange similarly extends beyond the slot to engage the hand guard interior. After both end connectors are positioned, the cover panel is joined with the end connectors by tilting and optionally snapping the cover rails into engagement with the connector rails. The ramped surfaces between the cover panel and the end connectors cooperate to urge the end connectors apart, together or one by one, optionally to better engage the end connectors with the slot and hand guard, creating a secure, fixed engagement with the hand guard slot ends. Removal of the assembly can be similarly straightforward, requiring no tools—simply reversing the process of engagement and allowing the user to service or reconfigure the cover assembly and its components quickly and easily.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Furthermore, the particular features, structures, or characteristics may be combined in any suitable manner with or in one or more embodiments.

What is claimed is:

1. A cover assembly for a weapon handguard comprising:

a cover panel including an exterior surface and an interior surface having a first cover rail and an opposing second cover rail;

a first end connector including a first base, a first capture flange extending from the first base and configured to engage an interior of the weapon handguard, the first base sized for locating between opposing side edges of an elongated slot defined by the weapon handguard, the first end connector including a first connector rail and an opposing second connector rail; and a second end connector, separate and distinct from the first end connector, the second end connector including a second base, a second capture flange extending from the second base and configured to engage the interior of the weapon handguard distal from the first flange, the second base sized for locating between opposing side edges of the elongated slot defined by the weapon handguard, the second end connector including a third connector rail and an opposing fourth connector rail, wherein the first connector rail and third connector rail engage the first cover rail, and the second connector rail and fourth connector rail engage the second cover rail, thereby securing the cover panel to the first connector and the second connector, wherein the cover panel engages the first end connector and the second end connector to space the first end connector and the second end connector at a fixed distance from one another such that the first capture flange and the second capture flange engage the interior of the weapon handguard to secure the cover panel fixedly to the weapon handguard.

2. The cover assembly of claim 1, wherein the first end connector defines a first cable slot above the first capture flange, the first cable slot configured to receive a cable that conveys voltage therethrough, wherein the second end connector defines a second cable slot above the second capture flange, the second cable slot configured to receive the cable.

3. The cover assembly of claim 1, wherein the cover panel includes a first cover panel ramp, wherein the first end connector includes a first end connector ramp, wherein the first cover panel ramp engages the first end connector ramp to urge the first end connector toward a first slot end of the slot.

4. The cover assembly of claim 3, wherein the cover panel includes a second cover panel ramp, wherein the second end connector includes a second end connector ramp, wherein the second cover panel ramp engages the second end connector ramp to urge the second end connector away from the first end connector and toward a second slot end of the slot distal from the first slot end.

5. The cover assembly of claim 1, wherein the first end connector is configured for positioning within the slot adjacent a first slot end, wherein the second end connector is configured for positioning within the slot adjacent a second slot end disposed opposite the first slot end along a longitudinal axis of the slot, wherein the cover panel engages the first end connector and the second end connector to urge the first end connector and the second end connector away from one another along the longitudinal axis to achieve the fixed distance therebetween.

6. The cover assembly of claim 1 comprising:

a ramp engaged between the cover panel and the first end connector, the ramp configured to urge the first end connector between the opposing side edges of the slot toward a first slot end.

7. The cover assembly of claim 1, wherein no portion of the cover panel, the first cover rail and the second cover rail extend into the slot when the cover assembly is fully installed relative to the handguard.

8. The cover assembly of claim 1, wherein the first end connector and cover panel define a cable passageway therebetween through which a cable is configured to extend and be retained therein.

9. The cover assembly of claim 8, wherein the cable passageway extends between the first cover rail and the second cover rail.

10. The cover assembly of claim 1, wherein the first capture flange is configured to extend beyond a first slot end to engage the interior of the handguard, and wherein the second capture flange is configured to extend beyond a second slot end, disposed forward of and opposite the first slot end along a longitudinal axis of the slot, to engage the interior of the handguard, a longitudinal axis of the slot, to engage the interior of the handguard.

11. A cover assembly for a weapon handguard comprising:

a cover panel including an exterior surface and an interior surface having opposing rails;

a first end connector and a second end connector, each being independent and separate from the cover panel, each including a capture flange configured to engage the interior of the handguard adjacent a longitudinal slot defined by the handguard at a respective forward slot end and a rearward slot end of the longitudinal slot, the first end connector and the second end connector captured by the opposing rails of the cover panel; and at least one ramp engaged between the cover panel and the first and second end connectors to space the first and second end connectors from one another, whereby the capture flange of each of the first end connector and the second end connector engages the interior of the handguard at the respective forward slot end and the rearward slot end to secure the cover panel fixedly to the handguard over the elongated slot.

12. The cover assembly of claim 11, wherein each of the first end connector and the second end connector defines a cable slot configured to contain a cable below the cover panel and above the exterior of the handguard.

13. The cover assembly of claim 11, wherein the cover panel is a solid plate without any apertures defined therein, wherein the opposing rails are defined on an interior of the plate.

14. The cover assembly of claim 11, wherein the first end connector includes first and second wings, wherein the second end connector includes third and fourth wings, wherein the first and third wings engage a first rail of the opposing rails, wherein the second and fourth wings engage a second rail of the opposing rails, wherein the opposing rails extend along a longitudinal axis of the cover panel.

15. The cover assembly of claim 11, wherein the capture flange of the first end connector faces forward and extends below the interior of the handguard at the forward slot end, forwardly beyond the elongated slot, wherein the capture flange of the second end connector faces forward and extends below the interior of the handguard at the rearward slot end, rearwardly beyond the elongated slot.

16. The cover assembly of claim 11, wherein the at least one ramp includes a cover panel forward ramp and a cover panel rearward ramp extending downward from a plate of the cover panel, wherein the at least one ramp includes a rearward facing ramp on the first end connector and a forward facing ramp on the second end connector, wherein the cover panel forward ramp is configured to engage the rearward facing ramp to urge the first end connector toward the forward slot end, wherein the cover panel rearward ramp is configured to engage the forward facing ramp to urge the second end connector toward the rearward slot end.

17. A method of using a cover assembly with a handguard, the method comprising:

providing a handguard with an elongated slot defined by a handguard, the slot including opposing side edges, a forward slot end and a rearward slot end;

moving a first end connector toward the forward slot end so that a first capture flange of the first end connector is positioned adjacent an interior of the handguard and extends forwardly beyond the forward slot end;

moving a second end connector toward the rearward slot end so that a second capture flange of the second end connector is positioned adjacent the interior of the handguard and extends rearwardly beyond the rearward slot end; and joining a cover panel with the first end connector and the second end connector after the first end connector and second end connector are disposed in the slot to secure the cover panel adjacent the handguard.

18. The method of claim 17, wherein the cover panel extends only exterior to the slot and handguard after said joining.

19. The method of claim 17 comprising:

urging the first end connector and the second end connector away from one another toward the respective forward slot and second slot end respectively.

20. The method of claim 17 comprising:

defining a cable slot atop the first end connector and the second end connector, and below the cover panel.

* * * * *